United States Patent [19]

Southern

[11] Patent Number: 4,754,842

[45] Date of Patent: Jul. 5, 1988

[54] LADDER SAFETY DEVICE

[76] Inventor: Don L. Southern, P.O. Box 280, Kingston, Ga. 30145

[21] Appl. No.: 148,474

[22] Filed: Jan. 26, 1988

[51] Int. Cl.[4] ..... E06C 7/48

[52] U.S. Cl. ..... 182/111; 182/214

[58] Field of Search ..... 182/111, 110, 108, 214; 248/210

[56] References Cited

U.S. PATENT DOCUMENTS

| | | | |
|---|---|---|---|
| 2,163,970 | 6/1939 | White | 182/111 |
| 2,200,902 | 5/1940 | Solomon | 182/110 |
| 2,904,128 | 9/1959 | Boham | 182/108 |
| 3,062,319 | 11/1962 | Wright | 182/108 |
| 3,318,416 | 5/1967 | Robinson | 182/214 |
| 3,780,828 | 12/1973 | Overturf | 182/111 |
| 4,444,291 | 4/1984 | McPherson | 182/107 |

FOREIGN PATENT DOCUMENTS

| | | | |
|---|---|---|---|
| 604163 | 4/1960 | Italy | 182/111 |
| 260403 | 11/1926 | United Kingdom | 182/111 |
| 2161528 | 1/1986 | United Kingdom | 182/107 |

*Primary Examiner*—Reinaldo P. Machado

*Attorney, Agent, or Firm*—Benoit, Smith & Laughlin

[57] ABSTRACT

An anti-slip attachment for each side rail of a ladder, designed to keep the ladder a predetermined distance away from a side wall of a building, has a bevelled end that allows a backing plate attached thereto and on which a resilient pad and a removable cover are mounted, to pivot at an angle of 0°-25° with respect to the axis of the ladder.

9 Claims, 1 Drawing Sheet

LADDER SAFETY DEVICE

BACKGROUND OF THE INVENTION

The present invention relates to a structurally novel attachment which lends itself to practical and reliable use on an upper end portion of each of the side rails of a conventional-type inclined ladder and to a ladder incorporating said attachment. The invention includes a bracket designed to keep the upper end of the ladder away from the building wall and has a backing plate on which a resilient pad and, optionally, a cover are attached, each of which is adapted to minimize the likelihood of the ladder slipping out of place and marring or damaging the siding-covered outside wall surface of a building.

The concept of providing inclined ladder rails with cushioned attachments is old and well known. U.S. Pat. No. 3,780,828 to Overturf describes an anti-slip ladder attachment in which the attachment consists of a pad of a material such as foam rubber pivotally attached to the side rail of the ladder. U.S. Pat. No. 2,904,128 to Boham et al describes a cushioned anti-skid, anti-scuff rail hood. A similar compressively resilient anti-slipping and anti-marring device is disclosed in U.S. Pat. No. 3,062,319 to Wright.

BRIEF DESCRIPTION OF THE INVENTION

The essential feature of the instant invention resides in the bracket member that is designed to be attached to each of the side rails of a ladder adjacent the ends thereof. The bracket member is angled and at its upper end has a backing plate pivotally attached thereto. The backing plate has a resilient pad attached thereto and, optionally, a removable cover designed to fit over the resilient pad and the outer periphery of the backing plate. The upper end of the bracket is bevelled to allow the backing plate to pivot over an angle of about 0° to 25° with respect to the axis or plane of the ladder. The backing plate has a C-shaped clamp welded thereto with provision for pivotally attaching the backing plate structure to the upper end of the bracket. The lower end of the bracket is designed to be attached to a side rail of a ladder in a manner such that it can be easily removed if desired.

An object of the invention is to provide anti-slip attachments to a ladder each of which includes an angled bracket designed to hold the top of the ladder a predetermined distance from the wall or siding.

It is another object of the invention to provide anti-slip attachments in which soft disposable pads are attached to backing plates that are in turn attached to the upper ends of brackets for attachment to the top ends of the side rails of a ladder.

A further object of the invention is to provide an anti-slip attachment in which the upper end of a bracket for attachment to the top end of the side rail of a ladder is bevelled in a manner such that a backing plate, pivotally attached to the bracket, is limited in its pivotal movement to about 0° to 25° with respect to the axis or plane of the ladder to increase the safety features of the attachment.

It is a still further object of the invention to provide outer disposable pads that have a gripping action on any surface and which can be easily removed and replaced as paint residue builds up on the pads.

Another object of the invention is to provide an anti-slip ladder attachment in which the length and angle of brackets, attached to each of the rails of a ladder, are designed to simplify working on the overhang of a building or a house. When the ladder is positioned directly under the overhang or faschia board of a building the ladder stands out from the wall surface at a reasonable working position.

These and other objects of the invention will become more apparent in the following description of a preferred embodiment of the invention.

DESCRIPTION OF THE PREFERRED EMBODIMENT

Figure 1:
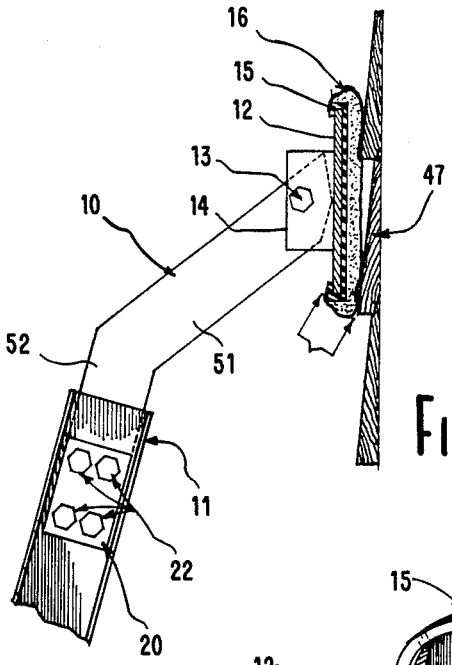
FIG. 1 is a side view, partly in section, of the ladder attachment showing its attachment to a ladder and positioning of the attachment against the siding of a building.

Referring now to FIG. 1, the novel ladder attachment comprises an upwardly angled bracket 10 which is attached at its lower end to each of the side rails 11 of a ladder, only one of which is shown. A backing plate 12 is pivotally attached to the upper end of the bracket 10 by means of a bolt 13 passing through a C-clamp 14 formed on the back of the backing plate 12. The backing plate 12 has a resilient pad 15 of neoprene, rubber or similar material attached thereto. A disposable cover 16 of a soft material is removably attached to the backing plate 12 and the resilient pad 15. The device is shown positioned against the exterior wall 47 of a building.

The dimensions of the bracket 10 and the angular relationship between the upper 51 and lower 52 portions of the bracket 10 should be such that the upper end of the ladder is supported about 12 to 14 inches from the wall of the building. The angle between the axes of the upper 51 and lower 52 portions of the bracket 10 is preferably an obtuse angle and ideally about 37°, though this may vary. The lower portion 52 of the bracket 10 may be of sufficient width to cooperate with the spaced flanges 35 of the ladder side rail 11 to provide a rigid connection between the bracket 10 and the side rail 11.

Figure 2:
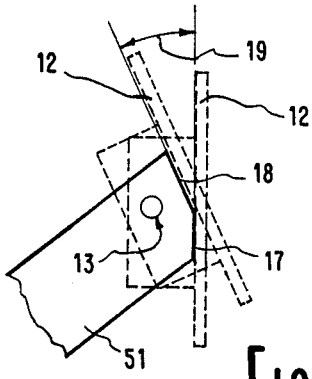
FIG. 2 is a diagrammatic side view showing the degree of pivot of the backing plate.

Referring now to FIG. 2, which shows one of the essential features of the device, the end of the bracket 10 opposite the ladder is bevelled at 17 and 18 such that the backing plate 12 can pivot around the bolt 13 allowing pivotal movement limited to about 0° to 25° relative to the axis or plane of the lower portion 52 of the bracket 10 or of the ladder 11. At 0° the backing plate 12 is parallel to the axis of the lower portion 52 of the bracket 10 or of the ladder 11. This is a convenient position for the backing plate 12 during storage of the ladder. The 25° limit is for safety purposes. The ladder should not be at an angle greater than 25° from the vertical. Since the backing plate 12 will not be parallel to the wall 47 if the ladder is at an angle greater than 25° the user of the ladder will want to be certain that the angle of the ladder is no more than 25° to assure that the backing plate is parallel to the wall.

Figure 3:
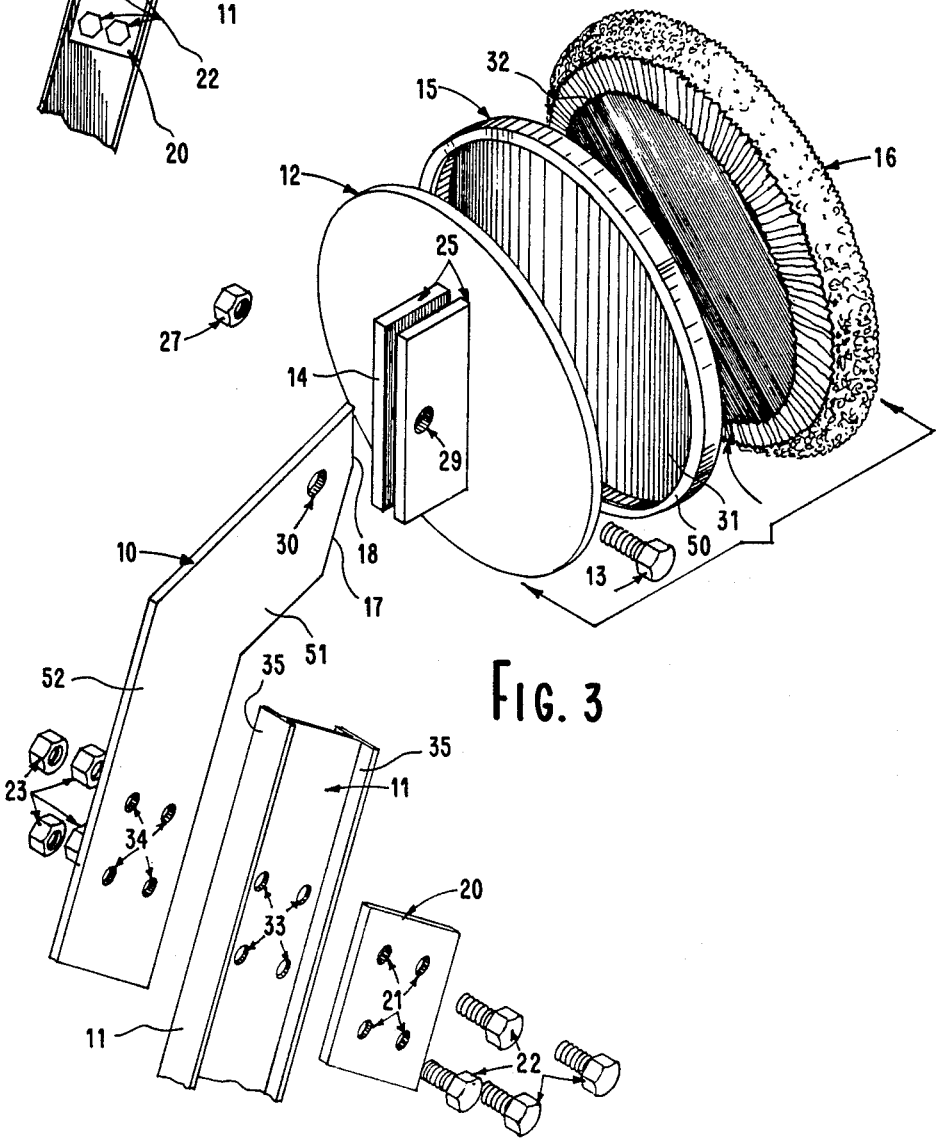
FIG. 3 is an expanded perspective view of the attachment showing its various elements in detail and of the upper end of a side rail of a ladder.

Referring now to FIG. 3, the lower portion of the bracket 10 is in a position to be attached to the side rail 11 of the ladder by means of a plate 20 having four apertures 21 for receiving bolts 22 which pass through apertures 33 in the side rail 11 and apertures 34 in the bracket 10 and are held in place by means of nuts 23. The figure shows the angular position of the bracket (37° between the axis of the upper and lower portions) and the bevelled portion 17 and 18 of the end of the upper portion. The C-clamp 14 is shown as consisting of two spaced elements 25 that are welded to the backing plate 12. The backing plate 12 is pivotally mounted on the bracket 10 by means of the bolt 13, passing through the apertures 29 of the C-clamp and the aperture 30 of the bracket 10, and nut 27.

The resilient protective pad 15 consists of a central, flat body portion 31 and an outer rim portion 50. The protective pad is premolded to fit on the backing plate 12 with the outer rim portion extending about the perimeter and inwardly on the back side of the backing plate as is shown in FIG. 1.

The disposable pad 16 is shown as a lambs wool pad designed to fit on and over the perimeter of the preformed resilient pad 15 and the backing plate 12. The pad is attached by means of an elastic band 32, about the perimeter of the pad, that holds the resilient pad in place. Alternatively, a drawstring passing through the perimeter of the pad and which can be tied may be used in place of the elastic band.

The resilient protective pad 15 is designed to be used without the disposable pad 16 when the user is pressure washing or water blasting the wall surface. In such instances the flat surface of the resilient protective pad 15 rests directly against the wall surface. The disposable pad 16 is designed to be used over the resilient protective pad 15 when the user is painting the wall surface. The pad will protect painted surfaces and can be replaced when it becomes impregnated with paint. Both the resilient protective pad 15 and the disposable pad 16 provide safe, non-slip surfaces for resting the upper end of the ladder against the wall to prevent the ladder from sliding on the wall surface and at the same time protect the surface of the wall from damage.

In use, two of the devices are attached to a ladder, one to each of the side rails 11. The brackets are attached by means of the plate 20 that are bolted through the apertures 21 in the plate and apertures 33 in the side rail 11 and 34 in the bracket 10.

An essential feature of the device resides in the length and angle of the bracket that positions the upper end of the ladder at about 12 to 14 inches away from the wall. Another feature is the presence of bevels on the upper end of the bracket 10 that allow the backing plate 12 to pivot over an angle of about 0° to 25° with respect to the axis of the ladder as shown at 19. This is a safety feature. The user is discouraged from inclining the ladder at an unsafe angle because the backing plate with the pads attached thereto will not fit flat against the wall 47 at other angles outside this range.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A safeguard device, for attachment to the upper end of a side rail of a ladder, adapted to rest against a vertical wall of a building, comprising, in combination:

(a) an extended, angular-shaped bracket having a predetermined angular relationship between the axes of the opposite ends thereof;

(b) means for securing one end of said angular-shaped bracket to said upper end of said side rail of said ladder;

(c) resilient pad means having a substantially flat front surface adapted for contacting said wall surface of a building;

(d) means pivotally securing said resilient pad means to the end of said angular-shaped bracket opposite said one end thereof;

(e) said extended, angular-shaped bracket having means for limiting the pivotal movement of said resilient pad means within a predetermined range such that said front surface of said resilient pad means will fully contact said surface of said wall when said ladder is within a predetermined angular range with respect to said vertical wall of said building;

and (f) said angular relationship between said opposite ends of said bracket being sufficient to maintain the top of the ladder at a predetermined distance from said wall.

2. The device according to claim 1 wherein said resilient pad means comprises a backing plate pivotally secured to said extended, angular-shaped bracket and a resilient member having a flange thereon for engaging the perimeter of said backing plate.

3. The device according to claim 2 further comprising a cover member arranged to removably fit over the perimeters of said resilient member and said backing plate.

4. The device according to claim 3 wherein said cover member further comprises an annular elastic member positioned about the edge of said cover member for securing said cover member on said resilient member and backing plate.

5. A device according th claim 2 wherein said backing plate further comprises a C-shaped clamp secured to the side thereof opposite said resilient pad means, said bracket having apertures therein for receiving means for pivotally securing said resilient pad means to said bracket.

6. The device according to claim 1 wherein said means for limiting the pivotal movement of said resilient pad means within a predetermined range comprises at least one bevelled surface on said end of said bracket which prevents pivotal movement of said resilient pad means beyond said predetermined range.

7. The device according to claim 1 wherein said means for limiting the pivotal movement of said resilient pad means limits the movement thereof to between about 0° to 25° with respect to the axis of said ladder.

8. The device according to claim 1 wherein said angular relationship between the axes of said opposite ends of said bracket is an obtuse angle.

9. The device according to claim 8 wherein said angular relationship between the axes of said opposite ends of said bracket is about 37° degrees.

* * * * *